US011244665B1

(12) United States Patent
Stevens

(10) Patent No.: US 11,244,665 B1
(45) Date of Patent: Feb. 8, 2022

(54) MUSICAL INSTRUMENT MALLET AND METHOD OF USE

(71) Applicant: Leigh H. Stevens, Neptune Township, NJ (US)

(72) Inventor: Leigh H. Stevens, Neptune Township, NJ (US)

( * ) Notice: Subject to any disclaimer, the term of this patent is extended or adjusted under 35 U.S.C. 154(b) by 0 days.

(21) Appl. No.: 16/874,759

(22) Filed: May 15, 2020

Related U.S. Application Data

(60) Provisional application No. 62/848,316, filed on May 15, 2019.

(51) Int. Cl.
*G10D 13/12* (2020.01)

(52) U.S. Cl.
CPC ..... *G10D 13/12* (2020.02)

(58) Field of Classification Search
CPC ..... G10D 13/12; G10D 3/00
See application file for complete search history.

(56) References Cited

U.S. PATENT DOCUMENTS 7,439,434 B1 * 10/2008 Cole ..... G10D 13/12 84/422.4
2012/0240747 A1 * 9/2012 Dumitru ..... G10D 13/12 84/422.4
2018/0322852 A1 * 11/2018 Navarro ..... B29C 45/345

* cited by examiner

*Primary Examiner* — Kimberly R Lockett
(74) *Attorney, Agent, or Firm* — Leavitt Eldredge Law Firm

(57) ABSTRACT

A musical instrument mallet includes a head extending from a first end to a second end, the head having a steel core; and a foam shell surrounding the steel core; a handle attached to the head at the second end; the head is used to inflict force upon an instrument; and the steel core and foam shell create a low volume sound with the instrument.

10 Claims, 4 Drawing Sheets

MUSICAL INSTRUMENT MALLET AND METHOD OF USE

BACKGROUND

1. Field of the Invention

The present invention relates generally to instrument mallets, and more specifically, to an instrument mallet intended to be used for nearly silent practice.

2. Description of Related Art

Hammers and mallets are used to drive nails, fit parts, forge metal, break apart objects, as well as stimulate vibration of musical instruments. Instrument mallets are well known in the art and are effective means to strike and create sound with a plurality of instruments. There are dozens of mallets and hammers described on the Internet, but all have the common feature of being designed to deliver energy efficiently to the surface being struck—exactly the same as with musical instrument mallets. One of the intensions of the invention herein described is to allow the wielder of the mallet to deliver a full force blow to the musical instrument, but not to transfer the energy of the stroke efficiently. All prior art in the field of "musical instrument mallets" produce predictable sound pressure levels commensurate with the energy of the stroke. In prior practice in the field, even musical instrument mallets described as "soft" are actually designed to produce high decibel volume, (Sound Pressure Levels), however, with emphasis on the fundamental, minimizing the stimulation of higher overtones.

Accordingly, although great strides have been made in the area of instrument mallets, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1A:
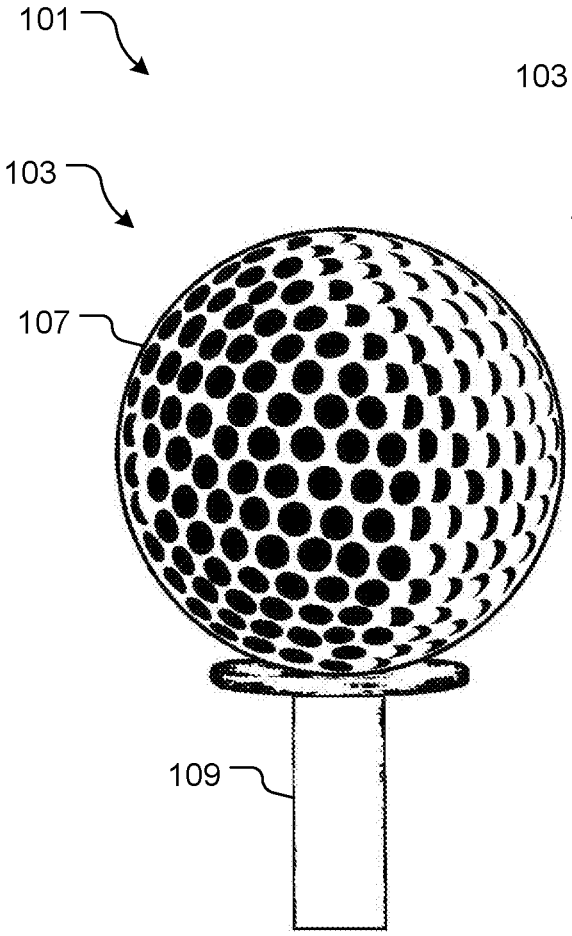
FIGS. 1A and 1B are front views of a first embodiment of an instrument mallet in accordance with the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional instrument mallets. Specifically, the mallet of the present invention allows a user to strike an instrument with full force, as if they were playing at their desired volume, while the mallet head causes a low volume sound. This and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 1B:
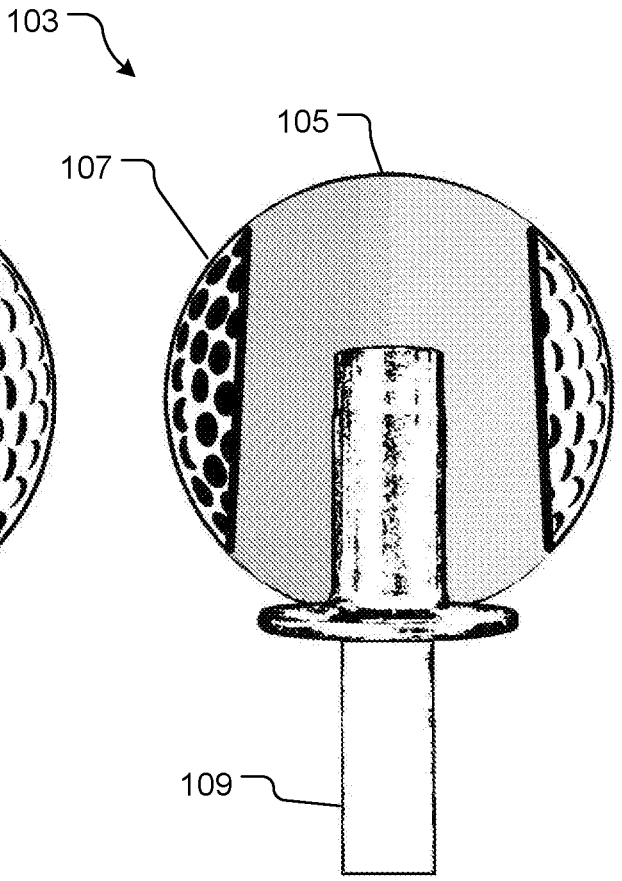

Referring now to the drawings wherein like reference characters identify corresponding or similar elements throughout the several views, FIG. 1 depicts a front view of a first embodiment of an instrument mallet 101 in accordance with the present application. It will be appreciated that mallet 101 overcomes one or more of the above-listed problems commonly associated with conventional mallets.

In the first mallet embodiment 101, is shown the most basic embodiment, wherein a head 103 of the mallet is comprised of two layers, the two layers having a high differential densities, namely a hard core 105 surrounded by a soft shell 107. The hard core may be composed of various dense materials including steel, aluminum, bronze, brass, or the like. It should further be appreciated that in the preferred embodiment, the soft shell is composed of foam, such as one of open cell foam, closed cell foam, polyurethane, latex foam, gel infused, or the like. It should be appreciated that in some embodiments, the core and shell are of equal mass. It should further be appreciated that the head can vary in shape and size, including both spherical and non-spherical shapes.

It should be appreciated that steel would commonly be considered unsuitable for use as a core on a musical instrument because it might damage the keyboard. Further, a thick foam outer shell would ordinarily be considered to be unsuitable for use as a cover of a mallet because it would be too soft to produce sound. However, it has been discovered that by juxtapositions of otherwise unacceptable materials in the correct weight, size, and surface area ratios, unique and useful sound and performance qualities are produced.

The musical instrument mallets of the aforementioned embodiment are primarily intended as very low-decibel practice mallets for use on marimba, vibraphone or xylophone, (tuned keyboard percussion instruments). While they retain the "feel" and weight range of a normal performance mallet, this embodiment transfers very little energy to the instrument, resulting in almost silent, but clearly audible tone. Other combinations of high differential densities produce additional surprising timbres and performance characteristics, with practical application to non-pitched percussion instruments such as snare drum, bass drum, timpani and cymbals.

Figure 2:
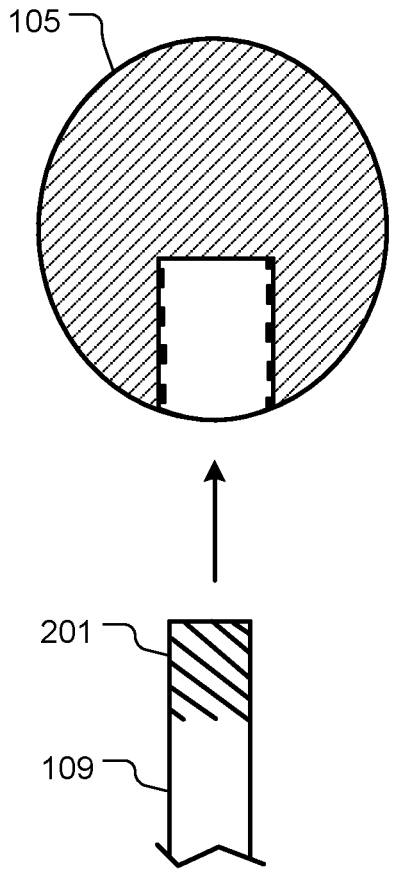
FIG. 2 is a front view depicting a first embodiment of a means of attachment of a handle to a head of a mallet of the present application.

As shown, this embodiment 101 further includes a handle 109. The handle can have various characteristics, be in various sizes, and composed of various materials, however, in one embodiment, the handle has a diameter between 6 mm and 10 mm. As shown in FIG. 2, in some embodiments, it is contemplated that the handle 103 can include a threaded connection 201 to engage with the core 105. In some embodiments, the handle is further glued in place, however, other means of attachment could be used.

Figure 3:
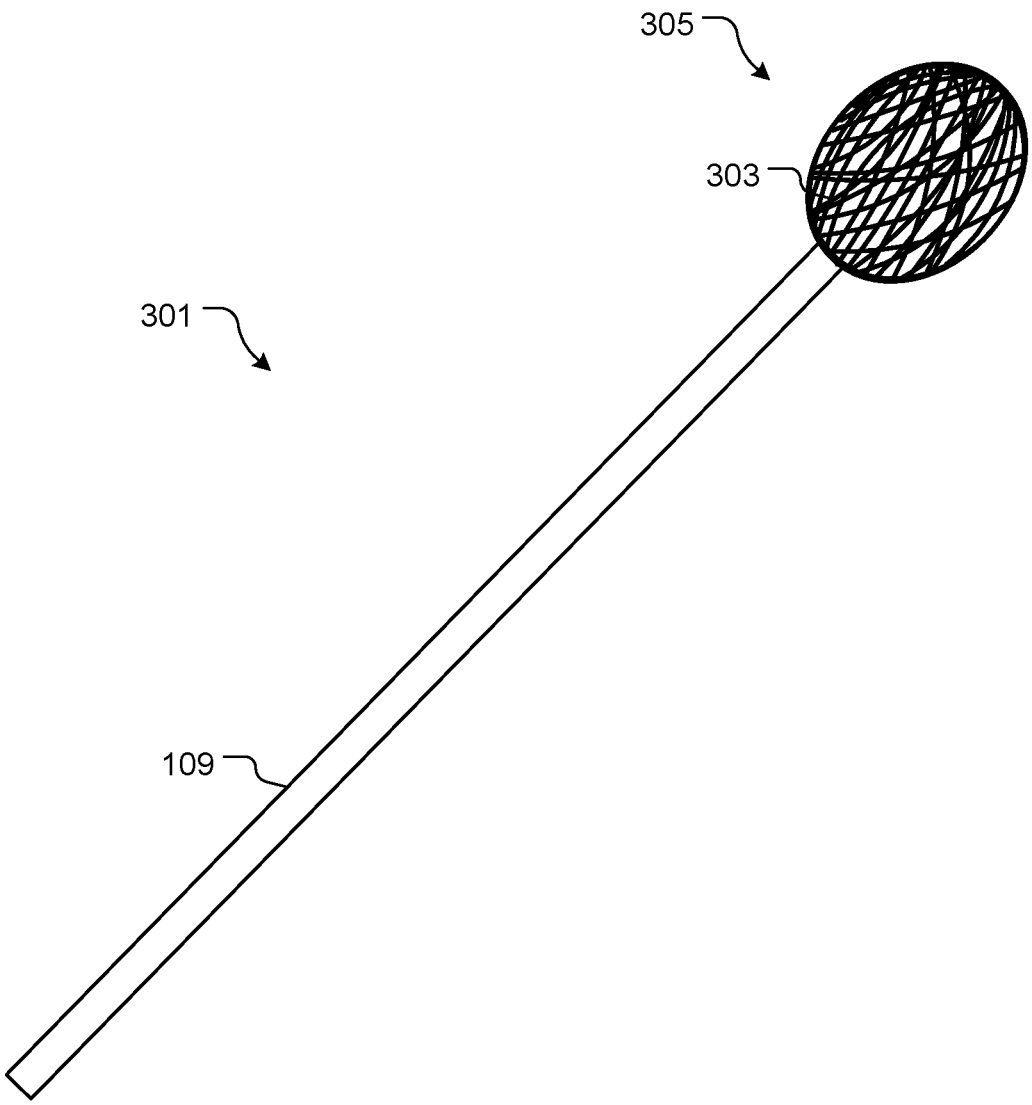
FIG. 3 is a front view of a second embodiment of an instrument mallet in accordance with the present application.

In FIG. 3, an alternative embodiment of a mallet 301 is shown. Mallet 301 includes all of the features discussed above, including the hard core and soft shell, however, in this embodiment, a yarn 303 is wrapped around the head 305 to complete the composition of the head. It should be appreciated and understood that the yarn 303 can vary in size, composition, and the like based on the needs of the user. Winding the outside of the 2-layer head in this manner (using various types of yarns, threads, strips of other materials in various angles and tensions) produces limitless additional combinations of articulations and sound timbres.

It should be appreciated that one of the unique features believed characteristic of the present application is the combination of a hard, dense core and an outer soft, absorptive layer, wherein these two layers have high differential densities.

Figure 4:
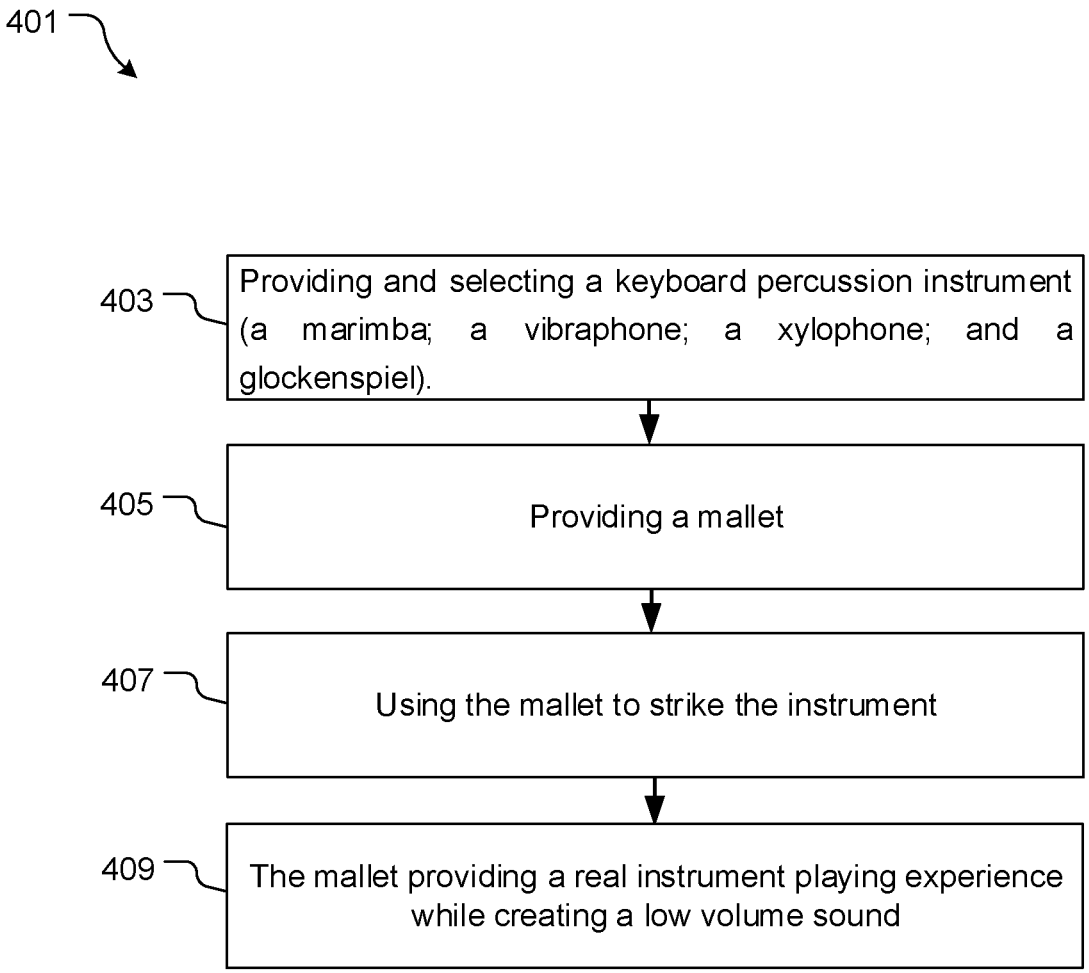
FIG. 4 is a flowchart of e method of use of the mallet of the present invention.

In FIG. 4, a flowchart 401 depicts a method of use of the mallet of the present invention. It should be appreciated that in a particular scenario, the user will select an instrument from a class of keyboard percussion instruments (a marimba; a vibraphone; a xylophone; and a glockenspiel), as shown with box 403. The user will then select a desired embodiment of a mallet based on their needs, as shown with box 405. The user will then proceed to use the mallet to strike the instrument, wherein striking the instrument creates a low volume sound, as shown with boxes 407, 409.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A musical instrument mallet, comprising:

a head extending from a first end to a second end, the head consisting of:

a hard core composed of a metallic material;

a soft shell surrounding the hard core, the soft shell is composed of a foam material; and a yarn material wrapped around the soft shell;

wherein the head is symmetrical from the first end to the second end and wherein the head is non-spherical;

wherein a density of the foam material is between a range of 50 to 150 times less dense than the metallic material;

wherein a foam weight of the foam material is substantially equal to a metallic weight of the metallic material;

a handle threadedly attached to the head at the second end;

wherein the head is used to inflict force upon an instrument; and wherein the hard core and foam shell create a low volume sound with the instrument as the soft shell absorbs energy.

2. The mallet of claim 1, wherein the hard core is composed of one of steel, aluminum, bronze, and brass.

3. The mallet of claim 1, wherein the hard core and soft shell have high differential densities.

4. The mallet of claim 1, wherein the hard core has an equal mass to the soft shell.

5. The mallet of claim 1, wherein the head is spherical in shape.

6. The mallet of claim 1, wherein the head is non-spherical in shape.

7. The mallet of claim 1, wherein the handle has a diameter between 6 mm and 10 mm.

8. A method of practicing an instrument, the method comprising:

providing a keyboard percussion instrument;

providing the mallet of claim 1; and using the mallet to strike the percussion instrument;

wherein the mallet creates a low volume sound associated with the percussion instrument.

9. The method of claim 8, wherein the keyboard percussion instrument is one of:

a marimba;

a vibraphone;

a xylophone; and a glockenspiel.

10. The method of claim 8, wherein the mallet further includes an exterior layer composed of a yarn.

* * * * *